US008673524B2

(12) United States Patent
Nakamura

(10) Patent No.: US 8,673,524 B2
(45) Date of Patent: Mar. 18, 2014

(54) ELECTROPHOTOGRAPHIC PHOTORECEPTOR, PROCESS CARTRIDGE, AND IMAGE FORMING APPARATUS

(75) Inventor: Hirofumi Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/608,649

(22) Filed: Sep. 10, 2012

(65) Prior Publication Data

US 2013/0252149 A1 Sep. 26, 2013

(30) Foreign Application Priority Data

Mar. 22, 2012 (JP) ..... 2012-066209

(51) Int. Cl.
*G03G 15/00* (2006.01)

(52) U.S. Cl.
USPC ..... 430/60; 430/64; 430/65

(58) Field of Classification Search
USPC ..... 430/60, 64, 65
See application file for complete search history.

(56) References Cited

U.S. PATENT DOCUMENTS 5,419,993 A 5/1995 Sakakibara et al.
5,663,283 A 9/1997 Sakakibara et al.
2003/0118927 A1 6/2003 Nakamura et al.
2003/0207191 A1 11/2003 Kadota
2004/0265720 A1 12/2004 Kadota
2006/0013616 A1 1/2006 Nukada et al.
2006/0088780 A1 4/2006 Kadota
2006/0275687 A1 12/2006 Kadota
2006/0283782 A1 12/2006 Kadota
2010/0158561 A1 * 6/2010 Mitsumori et al. ..... 399/111

FOREIGN PATENT DOCUMENTS

JP A-05-011483 1/1993
JP A-05-080572 4/1993
JP A-2002-123028 4/2002
JP A-2002-236391 8/2002
JP A-2003-186219 7/2003
JP A-2006-030698 2/2006

* cited by examiner

*Primary Examiner* — Hoa V Le
(74) *Attorney, Agent, or Firm* — Oliff PLC

(57) ABSTRACT

An electrophotographic photoreceptor includes a conductive substrate; an undercoat layer which is provided on the conductive substrate and includes a binder resin and metal oxide particles of which the surfaces are treated with at least two kinds of coupling agents of a first coupling agent having an electron-donating group and a second coupling agent having an electron-accepting group; and a photosensitive layer which is provided on the undercoat layer.

19 Claims, 5 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-066209 filed Mar. 22, 2012.

BACKGROUND

1. Technical Field

The present invention relates to an electrophotographic photoreceptor, a process cartridge, and an image forming apparatus.

2. Related Art

An electrophotographic image forming apparatus has been used for image forming apparatuses of copying machines, laser beam printers, and the like due to its high speed and high printing quality. Photoreceptors used for the image forming apparatuses have mainly been organic photoreceptors using an organic photoconductive material. When an organic photoreceptor is prepared, there are many cases in which an undercoat layer (sometimes called an intermediate layer) is formed above, for example, an aluminum substrate and a photosensitive layer, in particular, a photosensitive layer including a charge generation layer and a charge transport layer is formed.

SUMMARY

According to an aspect of the invention, there is provided an electrophotographic photoreceptor including a conductive substrate; an undercoat layer which is provided on the conductive substrate and includes a binder resin and metal oxide particles of which the surfaces are treated with at least two kinds of coupling agents of a first coupling agent having an electron-donating group and a second coupling agent having an electron-accepting group; and a photosensitive layer which is provided on the undercoat layer.

BRIEF DESCRIPTION OF THE DRAWINGS

Exemplary embodiments of the present invention will be described in detail based on the following figures, wherein.

DETAILED DESCRIPTION

Figure 1:
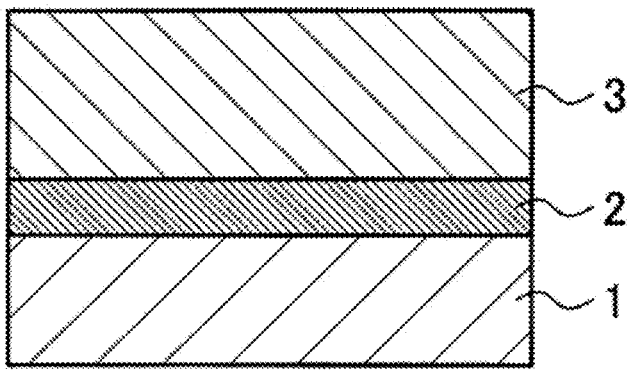
FIG. 1 is a diagram schematically illustrating an example of a layer configuration of an electrophotographic photoreceptor according to an exemplary embodiment of the invention.

Hereinafter, an exemplary embodiment which is an example of the invention will be described.

Electrophotographic Photoreceptor

An electrophotographic photoreceptor according to the exemplary embodiment (hereinafter, sometimes referred to as "the photoreceptor") includes a conductive substrate, an undercoat layer which is provided on the conductive substrate, and a photosensitive layer which is provided on the undercoat layer.

The undercoat layer includes a binder resin and metal oxide particles. The surfaces of the metal oxide particles are treated with at least two kinds of coupling agents of a first coupling agent having an electron-donating group and a second coupling agent having an electron-accepting group.

In recent years, the requirements for image quality, in particular, have become strict with regard to, for example, photoreceptors for the printing market. In order to meet the requirements, a technique is known in which the surfaces of metal oxide particles, which are blended into an undercoat layer of an electrophotographic photoreceptor, are treated with a coupling agent to improve the dispersibility of the particles and image quality.

However, this technique is not sufficient for the recent requirements for image quality, in particular, for image graininess.

Therefore, in the electrophotographic photoreceptor according to the exemplary embodiment, with the above-described configuration, an image with satisfactory graininess may be obtained.

The reason is not clear but is considered to be as follows.

First, image graininess deterioration is remarkably observed when the uniformity of an undercoat layer deteriorates. It is considered that this is because, when the uniformity of an undercoat layer deteriorates, a so-called sea-island structure in which there are portions where there are metal oxide particles and portions where there are no metal oxide particles, is formed in the undercoat layer.

On the other hand, it is considered that when the metal oxide particles, of which the surfaces are treated with at least two kinds of coupling agents of the first coupling agent having an electron-donating group and the second coupling agent having an electron-accepting group, are added to the undercoat layer, the dispersibility of the metal oxide particles of which the surfaces are treated with at least two kinds of coupling agents is improved more than that of the metal oxide particles of which the surfaces are treated with one coupling agent.

It is considered that, as a result of the dispersibility being improved, the metal oxide particles are likely to be uniformly dispersed in the undercoat layer in a layer thickness direction and in a layer surface direction (the direction intersecting with the layer thickness direction). Accordingly, it is considered that the uniformity of the undercoat layer in the above-described directions is improved.

Therefore, it is considered that, when the electrophotographic photoreceptor according to the exemplary embodiment is used, an image with satisfactory graininess is obtained.

In particular, in the undercoat layer having the above-described configuration, the movement of electrons is likely to be uniform and thus local concentration of electric field is avoidable. Therefore, deterioration of image graininess is suppressed even over time (even when images are continuously formed).

In addition, particularly in an image forming apparatus (process cartridge) provided with a contact charging type charging unit, it is considered that local electric discharge is likely to occur and, when the in-plane nonuniformity of the undercoat layer is large, abnormal electric discharge is likely to occur.

Therefore, in the image forming apparatus (process cartridge) provided with a contact charging type charging unit, image graininess is likely to deteriorate. However, by adopting the electrophotographic photoreceptor according to the exemplary embodiment, deterioration of image graininess may be suppressed and an image with satisfactory graininess may be obtained.

Hereinafter the electrophotographic photoreceptor according to the exemplary embodiment will be described with reference to the drawings.

FIGS. 1 to 6 are diagrams illustrating examples of a layer configuration of the photoreceptor according to the exemplary embodiment. A photoreceptor shown in FIG. 1 includes a conductive substrate 1, an undercoat layer 2 which is formed above the conductive substrate 1, and a photosensitive layer 3 which is formed above the undercoat layer 2.

Figure 2:
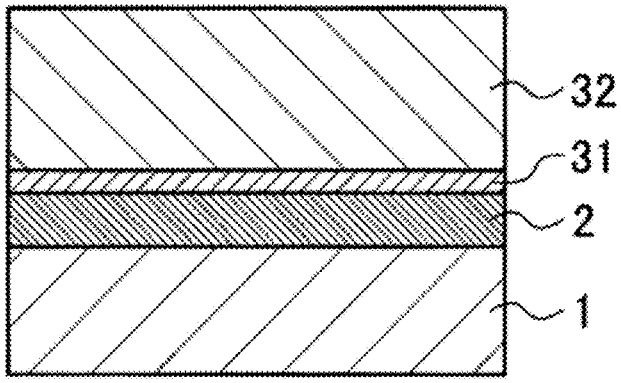
FIG. 2 is a diagram schematically illustrating another example of the layer configuration of the electrophotographic photoreceptor according to the exemplary embodiment.
Figure 3:
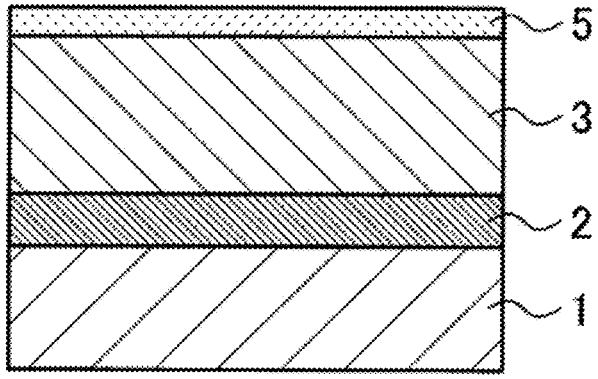
FIG. 3 is a diagram schematically illustrating another example of the layer configuration of the electrophotographic photoreceptor according to the exemplary embodiment.
Figure 4:
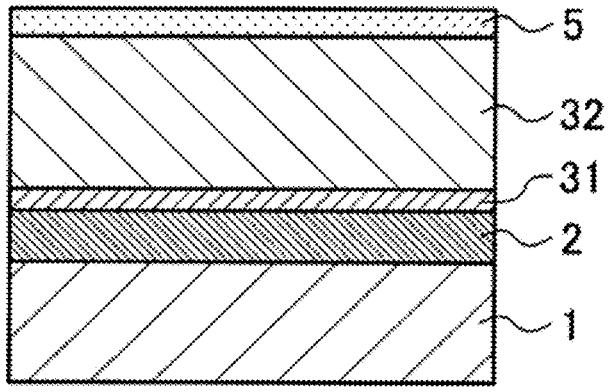
FIG. 4 is a diagram schematically illustrating another example of the layer configuration of the electrophotographic photoreceptor according to the exemplary embodiment.
Figure 5:
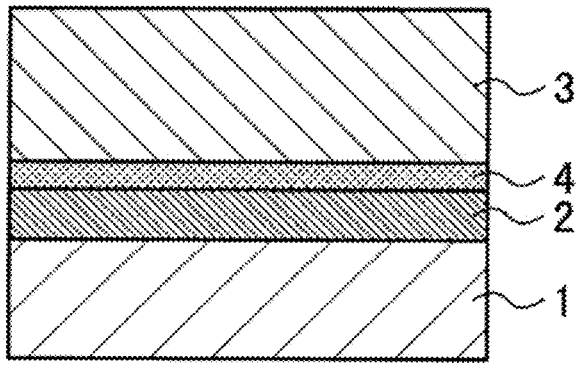
FIG. 5 is a diagram schematically illustrating another example of the layer configuration of the electrophotographic photoreceptor according to the exemplary embodiment.
Figure 6:
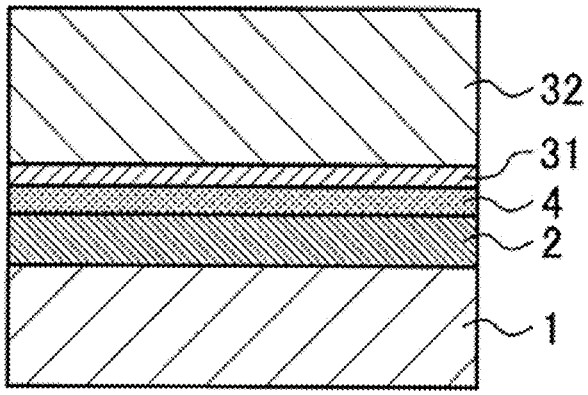
FIG. 6 is a diagram schematically illustrating another example of the layer configuration of the electrophotographic photoreceptor according to the exemplary embodiment.

In addition, as shown in FIG. 2, the photosensitive layer 3 may have a two-layer structure including a charge generation layer 31 and a charge transport layer 32. Furthermore, as shown in FIGS. 3 and 4, a protective layer 5 may be provided above the photosensitive layer 3 or above the charge transport layer 32. In addition, as shown in FIGS. 5 and 6, an intermediate layer 4 may be provided between the undercoat layer 2 and the photosensitive layer 3 or between the undercoat layer 2 and the charge generation layer 31.

Next, the respective elements of the electrophotographic photoreceptor will be described. In the following description, reference numerals will be omitted.

Conductive Substrate

As the conductive substrate, any substrates which are well-known in the related art may be used. Examples thereof include a plastic film in which a thin film (for example, a metal such as aluminum, nickel, chromium, or stainless steel and a film of aluminum, titanium, nickel, chromium, stainless steel, gold, vanadium, tin oxide, indium oxide, indium tin oxide (ITO), or the like) is provided; a paper to which a conductivity-imparting agent is applied or is immersed therein; and a plastic film to which a conductivity-imparting agent is applied or is immersed therein. The shape of the substrate is not limited to a circular shape and may be a sheet-shape or a plate-shape.

When a metal pipe is used as the conductive substrate, the surface of the pipe may be used as it is or may be treated in advance in various processes of mirror-cutting, etching, anodic oxidation, roughing, centerless grinding, sandblasting, wet honing, and the like.

Undercoat Layer

The undercoat layer includes a binder resin and metal oxide particles and optionally further include an electron-accepting compound.

Metal Oxide Particles

Examples of the metal oxide particles include particles of antimony oxide, indium oxide, tin oxide, titanium oxide, and zinc oxide.

Among these, as the metal oxide particles, tin oxide, titanium oxide, and zinc oxide are preferable from the viewpoint of improving image graininess.

As the metal oxide particles, conductive poweders of which the particle diameter of the metal oxide particles is preferably less than or equal to 100 nm and more preferably from 10 nm to 100 nm, are used. In this case, the particle diameter represents the average primary particle diameter. The average primary particle diameter of the metal oxide particles is a value obtained by observing and measuring the particles with a scanning electron microscope (SEM).

When the particle diameter of the metal oxide particles is less than 10 nm, the surface areas of the metal oxide particles may increase and the uniformity of a dispersion may deteriorate. On the other hand, when the particle diameter of the metal oxide particles is greater than 100 nm, it is expected that the particle diameter of secondary or higher particles be approximately 1 μm; a so-called sea-island structure in which there are portions where there are metal oxide particles and portions where there are no metal oxide particles, is likely to be formed in the undercoat layer; and image graininess deteriorates. As a result, image defects such as unevenness in halftone concentration may occur.

It is preferable that the powder resistance of the metal oxide particles is from $10^4$ Ω·cm to $10^{10}$ Ω·cm. As a result, the undercoat layer is likely to have appropriate impedance at a frequency corresponding to an electrophotographic process speed.

When the resistance value of the metal oxide particles is less than $10^4$ Ω·cm, the dependence of the impedance on the amount of the particles added may significantly increase and thus the control of the impedance may be difficult. When the resistance value of the metal oxide particles is greater than $10^{10}$ Ω·cm, residual potential may increase.

As the coupling agent with which the surfaces of the metal oxide particles are treated, at least two kinds of coupling agents of the first coupling agent having an electron-donating group and the second coupling agent having an electron-accepting group are used.

In this case, examples of the electron-donating group include an amino group and a tert-butyl group, but an amino group is preferable from the viewpoint of improving image graininess.

On the other hand, examples of the electron-accepting group include a fluorine-containing group and a chlorine-containing group, but a fluorine-containing group is preferable from the viewpoint of improving image graininess.

In addition, as the coupling agent, any one of silane coupling agents, titanate coupling agents, and aluminate coupling agents may be used, but a silane coupling agent is preferable from the viewpoint of improving image graininess.

That is, regarding the coupling agent, it is preferable that a silane coupling agent having an amino group be used as the first coupling agent and a silane coupling agent having a fluorine-containing group be used as the second coupling agent.

In addition, the first and second coupling agents may be used in combination with other coupling agents as a third coupling agent.

Examples of the silane coupling agent having an amino group include N-2-(aminoethyl)-3-aminopropyl methyl dimethoxysilane, N2-(aminoethyl)-3-aminopropyltrimethoxysilane, N2-(aminoethyl)-3-aminopropyltriethoxysilane, 3-aminopropyltrimethoxysilane, 3-aminopropyltriethoxysilane, 3-triethoxysilyl-N-(1,3-dimethyl-butylidene) propylamine, and N-phenyl-3-aminopropyltrimethoxysilane.

An example of the silane coupling agent having a fluorine-containing group (for example, a fluorinated alkyl group) includes a silane coupling agent represented by Formula (F) below.

$$F_3C—(CF_2)_{n1}—(CH_2)_{n2}—Si(OR_f)_3 \quad (F)$$

In Formula (F), $R_f$ represents an alkyl group having from 1 to 5 (preferably from 1 to 3) carbon atoms.

n1 represents an integer of from 0 to 8 (preferably from 0 to 5).

n2 represents an integer of from 0 to 5 (preferably from 0 to 3).

Specific examples of the silane coupling agent having a fluorine-containing group are as follows.

$$F_3C—(CH_2)_2—Si(OMe)_3 \quad (2\text{-}1):$$

$$F_3C—(CF_2)_3—(CH_2)_2—Si(OMe)_3 \quad (2\text{-}2):$$

$$F_3C—(CF_2)_5—(CH_2)_2—Si(OMe)_3 \quad (2\text{-}3):$$

$$F_3C—(CH_2)_2—Si(OiPr)_3 \quad (2\text{-}4):$$

$$F_3C—(CF_2)_3—(CH_2)_2—Si(OiPr)_3 \quad (2\text{-}5):$$

In the above formulae (2-1) to (2-5), Me represents a methyl group and iPr represents an isopropyl group.

Examples of other coupling agents include silane coupling agents such as vinyl trimethoxy silane, 3-methacryloxypropyl-tris(2-methoxyethoxy)silane, 2-(3,4-epoxycyclohexyl) ethyltrimethoxysilane, 3-glycidoxypropyltrimethoxysilane, vinyl triacetoxy silane, 3-mercaptopropyl trimethoxysilane, and 3-chloropropyl trimethoxysilane; aluminum coupling agents such as acetoalkoxy aluminum diisopropylate; and titanate coupling agents such as isopropyl triisostearoyl titanate, bis(dioctyl pyrophosphate), and isopropyl tri(N-amino-ethyl-aminoethyl) titanate.

The total amount of the coupling agents used for the surface treatment is preferably from 0.1% by weight to 3% by weight, more preferably from 0.3% by weight to 2.0% by weight, and still more preferably from 0.5% by weight to 1.5% by weight, with respect to the metal oxide particles.

When the total amount of the coupling agents used for the surface treatment is in the above-described range, image graininess is easily improved.

The surface treatment amount of the coupling agent is measured as follows.

There are analysis methods such as a FT-IR method, a solid-state 29 Si NMR method, thermal analysis, and XPS, but the FT-IR method, which is the simplest way, is used. The FT-IR method is also used for measurement of the ratio of the coupling agents described below. In the FT-IR method, a well-known KBr tablet method or an ATR method may be used. A small amount of surface-treated metal oxide particles are mixed well with KBr for FT-IR measurement. Accordingly, the total amount of the coupling agents used for the treatment is measured.

The ratio of the first coupling agent and the second coupling agent (first coupling agent/second coupling agent) is preferably from 3/7 to 7/3 and more preferably from 4/6 to 6/4 in terms of weight.

When the ratio of the first coupling agent and the second coupling agent is in the above-described range, image graininess is easily improved.

The ratio of the first coupling agent and the second coupling agent is measured as follows.

Similarly to the measurement of the total amount used for the treatment, the FT-IR method is used. Due to the difference between an electron-accepting substituent and an electron-donating substituent, the IR-peak is assigned and the mixing ratio is obtained.

The surfaces of the metal oxide particles may be treated with the first coupling agent and the second coupling agent independently of each other or at the same time.

After being treated with the coupling agent, optionally, the surfaces of the metal oxide particles may be thermally treated in order to improve the dependence of the resistance value on environments and the like. It is preferable that the temperature of the thermal treatment be from 150° C. to 300° C. and the treatment time be from 30 minutes to 5 hours.

The content of the metal oxide particles in the undercoat layer is preferably from 30% by weight to 60% by weight and more preferably from 35% by weight to 55% by weight, from the viewpoint of maintaining electrical characteristics.

As the methods of dispersing the metal oxide particles, well-known dispersion methods are used. Examples thereof include methods using a roll mill, a ball mill, a vibration ball mill, an attritor, a sand mill, a colloid mill, and a paint shaker.

Binder Resin

Examples of the binder resin include polymer resin compounds such as an acetal resin (for example, polyvinyl butyral), polyvinyl alcohol resin, casein, polyamide resin, cellulosic resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenol resin, phenol-formaldehyde resin, and melamine resin.

Electron-Accepting Compound

The electron-accepting compound is a material which is chemically reactive with the surfaces of the metal oxide particles included in the undercoat layer or a material which is adsorbed onto the surfaces of the metal oxide particles. The electron-accepting compound may be selectively present on the surfaces of the metal oxide particles.

As the electron-accepting compound, an electron-accepting compound having an acidic group is preferable from the viewpoint of suppressing concentration change (hereinafter, referred to as "ghost") caused by the history of a previous cycle. Examples of the acidic group include a hydroxyl group (phenol hydroxyl group), a carboxyl group, and a sulfonyl group.

Specific examples of the electron-accepting compound include quinones, anthraquinones, coumarins, phthalocyanines, triphenylmethanes, anthocyanins, flavones, fullerenes, ruthenium complexs, xanthenes, benzoxazines, and porphyrins.

In particular, anthraquinones (anthraquinone derivatives) are preferable as the electron-accepting compound in consideration of safety, availability, and electron transport capability of a material as well as the suppression of ghost. In particular, it is preferable that the electron-accepting compound have a structure represented by Formula (1) below.

Formula (1)

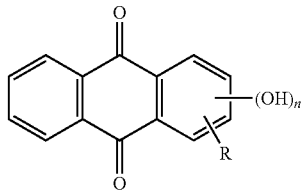

In Formula (1), n represents an integer of 1 to 3, and R represents a hydrogen atom, an alkyl group having 1 to 10 carbon atoms, or an alkoxy group having 1 to 10 carbon atoms.
Specific examples of the electron-accepting compound are shown below, but the electron-accepting compound is not limited to these examples.
1-1
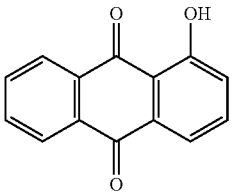
1-2
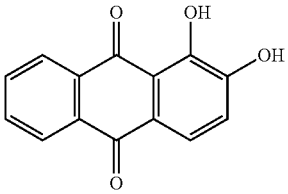
1-3
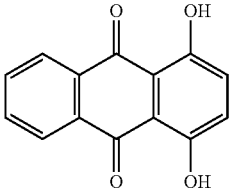
1-4
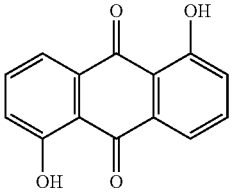
1-5
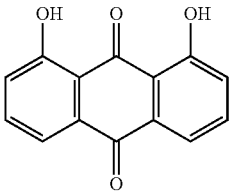
1-6
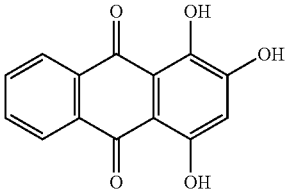
1-7
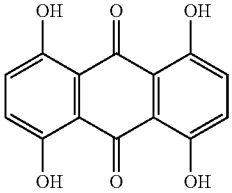
-continued
1-8
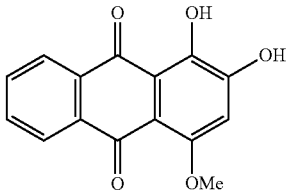
1-9
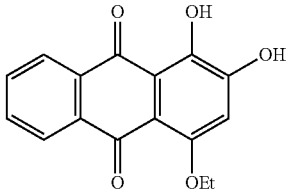
1-10
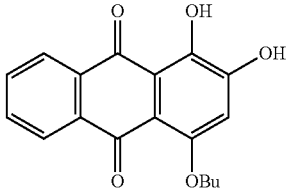
1-11
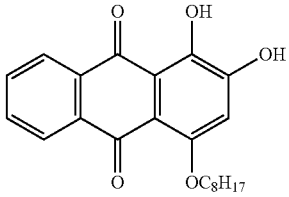
1-12
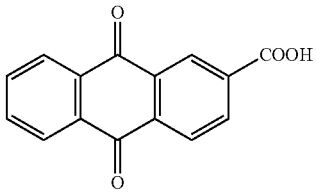
1-13
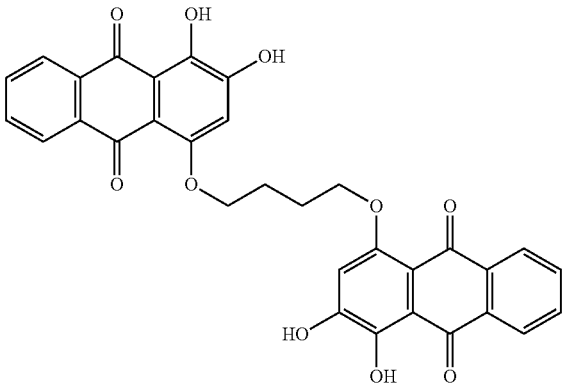

-continued 1-14

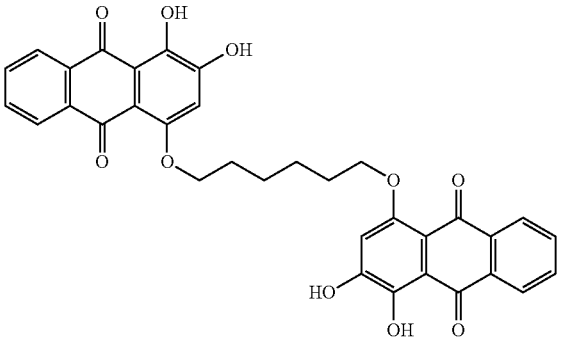

1-15

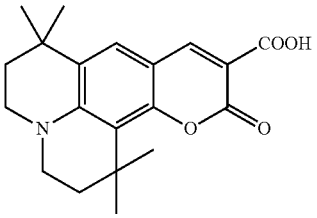

1-16

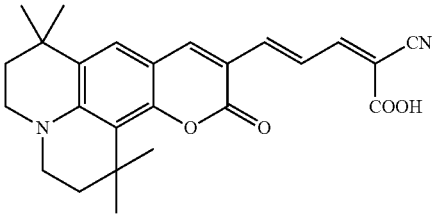

1-17

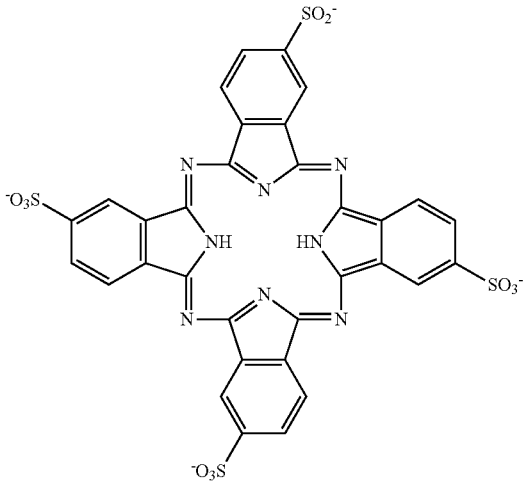

1-18

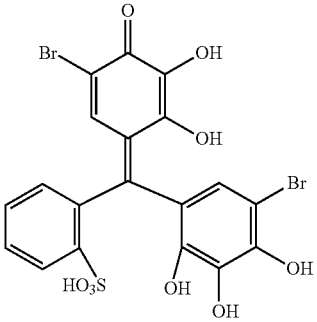

-continued 1-19

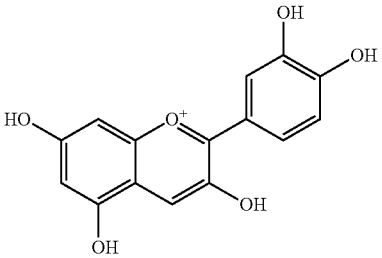

1-20

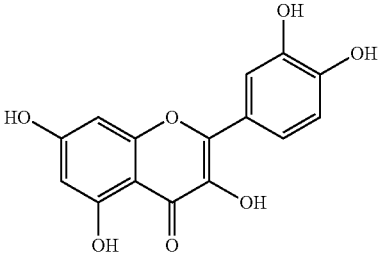

1-21

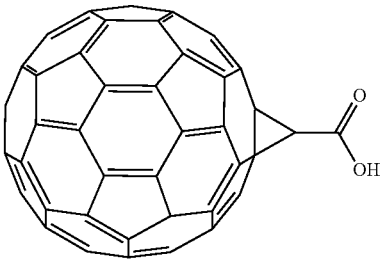

1-22

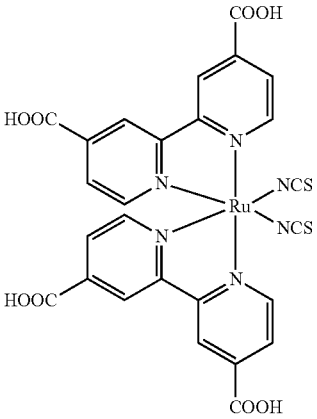

The content of the electron-accepting compound is determined based on the surface area and the content of the metal oxide particles, which is the target of the chemical reaction or the adsorption, and the electron transport capability of each material. In general, the content is preferably from 0.01% by weight to 20% by weight and more preferably from 0.1% by weight to 10% by weight.

When the content of the electron-accepting compound is less than 0.1% by weight, it may be difficult to exhibit an effect of an accepting material. On the other hand, when the content of the electron-accepting compound is greater than 20% by weight, the adhesion between the metal oxide particles is likely to occur. Therefore, the metal oxide particles are likely to be unevenly dispersed in the undercoat layer and it may be difficult to form a highly conductive path. As a result, residual potential increases, ghost occurs, and furthermore dark spots and unevenness in halftone concentration may occur.

Other Additives

An example of other additives includes resin particles. When coherent light such as laser light is used in an exposure device, it is preferable that moire fringes be prevented. To that end, it is preferable that the surface roughness of the undercoat layer be adjusted to be from ¼n (n represents the refractive index of an upper layer) to ½λ of a wavelength λ of exposure laser light which is used. In this case, the surface roughness may be adjusted by adding resin particles to the undercoat layer. Examples of the resin particles include silicone resin particles and cross-linked polymethyl methacrylate (PMMA) resin particles.

In addition, other additives are not limited to the above-described examples and well-known additives may be used.

Formation of Undercoat Layer

When the undercoat layer is formed, an undercoat-layer-forming coating solution in which the above-described components are added to a solvent, is used. The undercoat-layer-forming coating solution is obtained by, for example, preliminarily mixing or dispersing the metal oxide particles and optionally, the electron-accepting compound and other additives and dispersing the resultant in the binder resin.

Examples of the solvent used for obtaining the undercoat-layer-forming coating solution include well-known organic solvents for dissolving the above-described binder resin, such as alcohol solvents, aromatic solvents, halogenated hydrocarbon solvents, ketone solvents, ketone alcohol solvents, ether solvents, and ester solvents. As the solvent, these examples may be used alone or in a combination or two or more kinds.

Examples of a coating method of the undercoat-layer-forming coating solution include well-known coating methods such as a dip coating method, a blade coating method, a wire-bar coating method, a spray coating method, a bead coating method, an air knife coating method, and a curtain coating method.

The thickness of the undercoat layer is preferably greater than or equal to 15 μm, more preferably from 15 μm to 30 μm, and still more preferably from 20 μm to 25 μm, from the viewpoint of improving image graininess.

It is preferable that the Vickers hardness of the undercoat layer 2 be from 35 to 50.

Intermediate Layer

The intermediate layer may optionally be provided, for example, between the undercoat layer and the photosensitive layer in order to improve electrical characteristics, image quality, image quality maintainability, and photosensitive layer adhesion.

Although not shown in the drawings, the intermediate layer may be further provided between the undercoat layer and the photosensitive layer. Examples of a binder resin used for the intermediate layer include polymer resin compounds such as an acetal resin (for example, polyvinyl butyral), polyvinyl alcohol resin, casein, polyamide resin, cellulosic resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenol-formaldehyde resin, and melamine resin; and organometallic compounds containing atoms of zirconium, titanium, aluminum, manganese, silicon, or the like. These compounds may be used alone or as a mixture or a polycondensate of plural compounds. Among these, organometallic compounds containing atoms of zirconium or silicon are preferable from the viewpoints of low residual potential, less potential change depending on environments, and less potential change due to repetitive use.

When the intermediate layer is formed, an intermediate-layer-forming coating solution in which the above-described components are added to a solvent, is used.

Examples of a coating method for forming the intermediate layer include well-known methods such as a dip coating method, a push-up coating method, a wire-bar coating method, a spray coating method, a blade coating method, a knife coating method, and a curtain coating method.

The intermediate layer has a function as an electric blocking layer in addition to a function of improving the coating property of an upper layer. However, when the thickness of the layer is too large, an electrical barrier works strongly, which may lead to desensitization or potential increase due to repetitive use. Therefore, when the intermediate layer is formed, it is preferable that the thickness of the intermediate layer be from 0.1 μm to 3 μm. In addition, the intermediate layer at this time may be used as the undercoat layer.

Charge Generation Layer

The charge generation layer includes, for example, a charge generation material and a binder resin.

Examples of the charge generation material include phthalocyanine pigments such as metal-free phthalocyanine, chlorogallium phthalocyanine, hydroxygallium phthalocyanine, dichlorotin phthalocyanine, and titanyl phthalocyanine. In particular, for example, a chlorogallium phthalocyanine crystal having distinct diffraction peaks at Bragg angles (2θ±)0.2° with respect to CuKα characteristic X-rays of at least 7.4°, 16.6°, 25.5°, and 28.3°; a metal-free phthalocyanine crystal having distinct diffraction peaks at Bragg angles (2θ±)0.2° with respect to CuKα characteristic X-rays of at least 7.7°, 9.3°, 16.9°, 17.5°, 22.4°, and 28.8°; a hydroxygallium phthalocyanine crystal having distinct diffraction peaks at Bragg angles (2θ±)0.2° with respect to CuKα characteristic X-rays of at least 7.5°, 9.9°, 12.5°, 16.3°, 18.6°, 25.1°, and 28.3°; and a titanyl phthalocyanine crystal having distinct diffraction peaks at Bragg angles (2θ±0.2° with respect to CuKα characteristic X-rays of at least 9.6°, 24.1°, and 27.2°. Furthermore, examples of the charge generation material include quinone pigments, perylene pigments, indigo pigments, bisbenzimidazole pigments, anthrone pigments, and quinacridone pigments. In addition, as the charge generation material, these examples may be used alone or in a combination of two or more kinds.

Examples of the binder resin constituting the charge generation layer include bisphenol A type or bisphenol Z type polycarbonate resin, acrylic resin, methacrylic resin, polyarylate resin, polyester resin, polyvinyl chloride resin, polystyrene resin, acrylonitrile-styrene copolymer resin, acrylonitrile-butadiene copolymer resin, polyvinyl acetate resin, polyvinyl formal resin, polysulfone resin, styrene-butadiene copolymer resin, vinylidene chloride-acrylonitrile copolymer resin, vinyl chloride-vinyl acetate-maleic anhydride resin, silicone resin, phenol-formaldehyde resin, polyacrylamide resin, polyamide resin, and poly-N-vinylcarbazole resin. As the binder resin, these examples may be used alone or in a combination of two or more kinds.

It is preferable that the mixing ratio of the charge generation material and the binder resin be, for example, from 10:1 to 1:10.

When the charge generation layer is formed, a charge-generation-layer-forming coating solution in which the above-described components are added to a solvent, is used.

Examples of a method of dispersing particles (for example, particles of the charge generation material) in the charge-generation-layer-forming coating solution, include methods using medium dispersing machines such as a ball mill, a vibration ball mill, an attritor, a sand mill, and a horizontal sand mill; and mediumless dispersing machines such as a stirrer, an ultrasonic wave disperser, a roll mill, and a high-pressure homogenizer. Examples of the high-pressure homogenizer include a collision type of dispersing a dispersion in high-pressure state through liquid-liquid collision or liquid-wall collision; and a pass-through type of dispersing a dispersion by causing it to pass through a fine flow path in a high-pressure state.

Examples of a method of coating the undercoat layer with the charge-generation-layer-forming coating solution include a dip coating method, a push-up coating method, a wire-bar coating method, a spray coating method, a blade coating method, a knife coating method, and a curtain coating method.

The thickness of the charge generation layer is preferably from 0.01 μm to 5 μm and more preferably from 0.05 μm to 2.0 μm.

Charge Transport Layer

The charge transport layer includes a charge transport material and optionally, a binder resin.

Examples of the charge transport material include hole transport materials such as oxadiazole derivatives (for examples, 2,5-bis(p-diethylaminophenyl)-1,3,4-oxadiazole), pyrazoline derivatives (for example, 1,3,5-triphenyl-pyrazoline and 1-[pyridyl-(2)]-3-(p-diethylaminostyryl)-5-(p-diethylamino styryl)pyrazoline), aromatic tertiary amino compounds (for example, triphenylamine, N—N'-bis(3,4-dimethylphenyl)biphenyl-4-amine, tri(p-methylphenyl) aminyl-4-amine, and dibenzyl aniline), aromatic tertiary diamino compounds (for example, N,N'-bis(3-methylphenyl)-N,N'-diphenyl benzidine), 1,2,4-triazine derivatives (for example, 3-(4'-dimethylaminophenyl)-5,6-di-(4'-methoxyphenyl)-1,2,4-triazine), hydrazone derivatives (for example, 4-diethylaminobenzaldehyde-1,1-diphenyl hydrazone), quinazoline derivatives (for example, 2-phenyl-4-styryl-quinazoline), benzofuran derivatives (for example, 6-hydroxy-2,3-di(p-methoxyphenyl)benzofuran), α-stilbene derivatives (for example, p-(2,2-diphenylvinyl)-N,N-diphenyl aniline), enamine derivatives, and carbazole derivatives (for example, N-ethylcarbazole), and poly-N-vinylcarbazole and derivatives thereof; electron transport materials such as quinone compounds (for example, chloranil and bromoanthraquinone), tetracyanoquinodimethane compounds, fluorenone compounds (for example, 2,4,7-trinitrofluorenone and 2,4,5,7-tetranitro-9-fluororenone), xanthone compounds, and thiophene compounds; and polymers having a group which includes the above-mentioned compounds in the main chain or a side chain thereof. As the charge transport material, these examples may be used alone or in a combination of two or more kinds.

Examples of the binder resin constituting the charge transport layer include insulating resins such as bisphenol A type or bisphenol Z type polycarbonate resin, acrylic resin, methacrylic resin, polyarylate resin, polyester resin, polyvinyl chloride resin, polystyrene resin, acrylonitrile-styrene copolymer resin, acrylonitrile-butadiene copolymer resin, polyvinyl acetate resin, polyvinyl formal resin, polysulfone resin, styrene-butadiene copolymer resin, vinylidene chloride-acrylonitrile copolymer resin, vinyl chloride-vinyl acetate-maleic anhydride resin, silicone resin, phenol-formaldehyde resin, polyacrylamide resin, polyamide resin, and chlorine rubber; organic photoconductive polymers such as polyvinyl carbazole, polyvinyl anthracene, and polyvinyl pyrene. As the binder resin, these examples may be used alone or in a combination of two or more kinds.

It is preferable that the mixing ratio of the charge transport material and the binder resin be, for example, from 10:1 to 1:5.

The charge transport layer is formed using a charge-transport-layer-forming coating solution in which the above-described components are added to a solvent.

Examples of a method of coating the charge generation layer with the charge-transport-layer-forming coating solution include well-known methods such as a dip coating method, a push-up coating method, a wire-bar coating method, a spray coating method, a blade coating method, a knife coating method, and a curtain coating method.

The thickness of the charge transport layer is preferably from 5 μm to 50 μm and more preferably from 10 μm to 40 μm.

Protective Layer

The protective layer is optionally provided on the photosensitive layer. The protective layer is provided in order to prevent the chemical change of the charge transport layer, when being charged, in the photoreceptor having a laminated structure and to further improve the mechanical strength of the photosensitive layer.

Accordingly, it is preferable that a layer containing a cross-linking substance (hardened substance) be used as the protective layer. Configuration examples of the layer include well-known layer configurations such as a hardened layer having a composition which contains a reactive charge transport material and optionally a hardening resin; and a hardened layer in which the charge transport material is dispersed in a hardening resin. In addition, as the protective layer, a layer in which the charge transport material is dispersed in the binder resin may be used.

The protective layer is formed using a protective-layer-forming coating solution in which the above-described components are added to a solvent.

Examples of a method of coating the charge generation layer with the protective-layer-forming coating solution includes well-known methods such as a dip coating method, a push-up coating method, a wire-bar coating method, a spray coating method, a blade coating method, a knife coating method, and a curtain coating method.

The thickness of the protective layer is preferably from 1 μm to 20 μm and more preferably from 2 μm to 10 μm.

Single-Layered Photosensitive Layer

A single-layered photosensitive layer (charge generation and transport layer) may include, for example, a binder resin, a charge generation material, and a charge transport material. These materials are the same as the above-described materials used in the charge generation layer and the charge transport layer.

In the single-layered photosensitive layer, the content of the charge generation material is preferably from 10% by weight to approximately 85% by weight and more preferably from 20% by weight to 50% by weight. In addition, the content of the charge transport material is preferably from 5% by weight to 50% by weight.

A method of forming the single-layered photosensitive layer is the same as the method of forming the charge generation layer or the charge transport layer. The thickness of the single-layered photosensitive layer is preferably from 5 μm to 50 μm and more preferably from 10 μm to 40 μm.

Others

In the electrophotographic photoreceptor according to the exemplary embodiment, in order to prevent the photoreceptor from deteriorating due to ozone and oxidizing gas generated in an image forming apparatus; or light and heat, additives such as an antioxidant, a light stabilizer, and a heat stabilizer may be added to the photosensitive layer or the protective layer.

In addition, in order to increase sensitivity and to reduce residual potential and fatigue due to repetitive use, at least one electron-accepting material may be added to the photosensitive layer or the protective layer.

In addition, in the photosensitive layer or the protective layer, silicone oil may be added to the coating solutions for forming the respective layers as a leveling agent to improve the smoothness of a coating layer.

Image Forming Apparatus

Next, an image forming apparatus according to the exemplary embodiment will be described.

The image forming apparatus according to the exemplary embodiment includes the electrophotographic photoreceptor according to the exemplary embodiment; a charging unit that charges a surface of the electrophotographic photoreceptor; an electrostatic latent image forming unit that forms an electrostatic latent image on a charged surface of the electrophotographic photoreceptor; a developing unit that forms a toner image by developing the electrostatic latent image, which is formed on the surface of the electrophotographic photoreceptor, using toner; and a transfer unit that transfers the toner image, which is formed on the surface of the electrophotographic photoreceptor, onto a recording medium.

Figure 7:
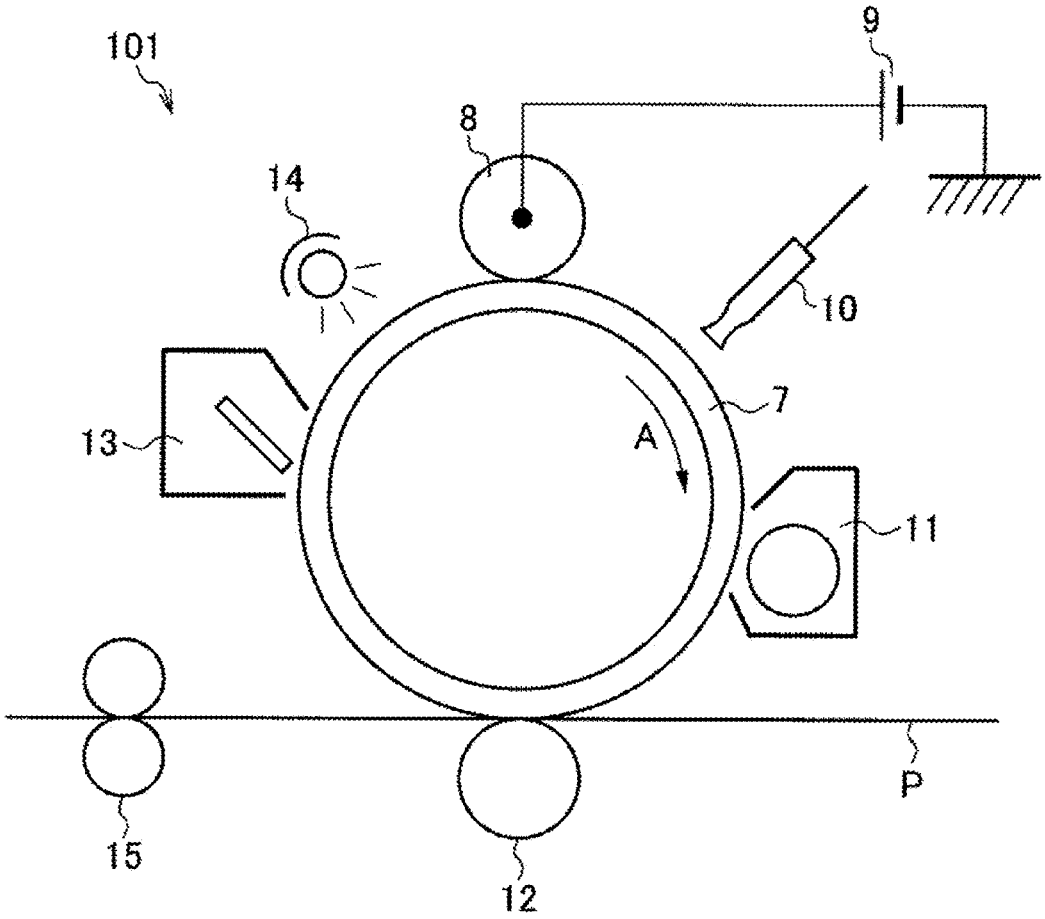
FIG. 7 is a diagram schematically illustrating a configuration of an image forming apparatus according to the exemplary embodiment.

FIG. 7 is a diagram schematically illustrating an example of an image forming apparatus according to the exemplary embodiment. An image forming apparatus 101 shown in FIG. 7 includes a drum-shaped (cylindrical) electrophotographic photoreceptor 7 according to the exemplary embodiment, for example, which is rotatably provided. Around the electrophotographic photoreceptor 7, for example, a charging device 8, an exposure device 10, a developing device 11, a transfer device 12, a cleaning device 13 and an erasing device 14 are disposed in this order along a moving direction of the outer circumferential surface of the electrophotographic photoreceptor 7. The cleaning device 13 and the erasing device 14 are optionally provided.

Charging Device

The charging device 8 is connected to a power supply 9 and charges the surface of the electrophotographic photoreceptor 7 using voltage applied from the power supply 9.

Examples of the charging device 8 include contact charging devices using a charging roller, a charging brush, a charging film, a charging rubber blade, a charging tube, and the like which are conductive. In addition, examples of the charging device 8 include non-contact roller charging devices and well-known charging devices such as a scorotron charger or corotron charger using corona discharge. As the charging device 8, contact charging devices are preferable.

Exposure Device

The exposure device 10 forms an electrostatic latent image on the electrophotographic photoreceptor 7 by exposing the charged electrophotographic photoreceptor 7 to light.

Examples of the exposure device 10 include optical devices in which the surface of the electrophotographic photoreceptor 7 is imagewise exposed to light such as semiconductor laser light, LED light, and liquid crystal shutter light. It is preferable that the wavelength of a light source fall within the spectral sensitivity range of the electrophotographic photoreceptor 7. It is preferable that the wavelength of a semiconductor laser light be in the near-infrared range having an oscillation wavelength of about 780 nm. However, the wavelength is not limited thereto. Laser light having an oscillation wavelength of about 600 nm or laser light having an oscillation wavelength of 400 nm to 450 nm as blue laser light may be used. In addition, in order to form a color image, as the exposure device 10, for example, a surface-emitting laser light source of emitting multiple beams is also effective.

Developing Device

The developing device 11 forms a toner image by developing the electrostatic latent image using a developer. It is preferable that the developer include toner particles with a volume average particle diameter of 3 μm to 9 μm which is obtained by polymerization. The developing device 11 has a configuration in which a developing roller is disposed opposite the electrophotographic photoreceptor 7 in a developing range of a container containing a two-component developer which includes toner and a carrier.

Transfer Device

The transfer device 12 transfers the toner image, which is developed on the electrophotographic photoreceptor 7, onto a transfer medium.

Examples of the transfer device 12 include contact transfer charging devices using a belt, a roller, a film, a rubber blade, and the like; and well-known transfer charging devices such as scorotron transfer charger or corotron transfer charger using corona discharge.

Cleaning Device

The cleaning device 13 removes toner remaining on the electrophotographic photoreceptor 7 after transfer.

It is preferable that the cleaning device 13 include a cleaning blade which is in contact with the electrophotographic photoreceptor 7 at a linear pressure of from 10 g/cm to 150 g/cm. The cleaning device 13 includes, for example, a case, a cleaning blade, and a cleaning brush which is disposed downstream of the cleaning blade in a rotating direction of the electrophotographic photoreceptor 7. In addition, for example, a solid lubricant is disposed in contact with the cleaning brush.

Erasing Device

The erasing device 14 erases a potential remaining on the surface of the electrophotographic photoreceptor by irradiating the surface of the electrophotographic photoreceptor 7 with erasing light after the toner image is transferred. For example, the erasing device 14 removes the difference between potentials of an exposed portion and an unexposed portion which is generated on the surface of the electrophotographic photoreceptor 7 by the exposure device 10, by irradiating the entire area of the electrophotographic photoreceptor 7 with erasing light in an axial direction and a width direction.

A light source of the erasing device 14 is not particularly limited, and examples thereof include a tungsten lamp (for example, white light) and a light emitting diode (LED; for example, red light).

Fixing Device

The image forming apparatus 101 includes a fixing device 15 which fixes the toner image on a recording medium P after the transfer process. The fixing device is not particularly limited and examples thereof include well-known fixing devices such as a heat roller fixing device and an oven fixing device.

Next, the operations of the image forming apparatus 101 according to the exemplary embodiment will be described. First, the electrophotographic photoreceptor 7 is charged to a negative potential by the charging device 8 while rotating along a direction indicated by arrow A.

The surface of the electrophotographic photoreceptor 7, which is charged to a negative potential by the charging device 8, is exposed to light by the exposure device 10 and an electrostatic latent image is formed thereon.

When a portion of the electrophotographic photoreceptor 7, where the electrostatic latent image is formed, approaches the developing device 11, toner is attached onto the electrostatic latent image by the developing device 11 and thus a toner image is formed.

When the electrophotographic photoreceptor 7 where the toner image is formed further rotates in the direction indicated by arrow A, the toner image is transferred onto the recording medium P by the transfer device 12. As a result, the toner image is formed on the recording medium P.

The toner image, which is formed on the recording medium P, is fixed on the recording medium P by the fixing device 15.

Process Cartridge

The image forming apparatus according to the exemplary embodiment may include a process cartridge which includes the electrophotographic photoreceptor 7 according to the exemplary embodiment and is detachable from the image forming apparatus.

The process cartridge according to the exemplary embodiment is not limited as long as it includes the electrophotographic photoreceptor 7 according to the exemplary embodiment. For example, in addition to the electrophotographic photoreceptor 7, the process cartridge may further include at least one component selected from the charging device 8, the exposure device 10, the developing device 11, the transfer device 12, the cleaning device 13, and the erasing device 14.

In addition, the image forming apparatus according to the exemplary embodiment is not limited to the above-described configurations. For example, a first erasing device for aligning the polarity of remaining toner and facilitating the cleaning brush to remove the remaining toner may be provided downstream of the transfer device 12 in the rotating direction of the electrophotographic photoreceptor 7 and upstream of the cleaning device 13 in the rotating direction of the electrophotographic photoreceptor 7; or a second erasing device for erasing the charge on the surface of the electrophotographic photoreceptor 7 may be provided downstream of the cleaning device 13 in the rotating direction of the electrophotographic photoreceptor 7 and upstream of the charging device 8 in the rotating direction of the electrophotographic photoreceptor 7.

In addition, the image forming apparatus according to the exemplary embodiment is not limited to the above-described configurations and well-known configurations may be adopted. For example, an intermediate transfer type image forming apparatus, in which the toner image, which is formed on the electrophotographic photoreceptor 7, is transferred onto an intermediate transfer medium and then transferred onto the recording medium P, may be adopted; or a tandem-type image forming apparatus may be adopted.

The electrophotographic photoreceptor according to the exemplary embodiment may be applied to an image forming apparatus which does not include the erasing device.

EXAMPLES

Hereinafter, the exemplary embodiment will be described in detail with reference to Examples and Comparative Examples but is not limited thereto.

Surface Treatment Example 1

100 parts by weight of zinc oxide (trade name: MZ-300, manufactured by TAYCA CORPORATION) as the metal oxide particles, 0.5 part by weight of N-2-(aminoethyl)-3-aminopropyltrimethoxysilane as the first coupling agent, and 200 parts by weight of toluene are mixed and stirred, followed by reflux for 2 hours. Then, toluene is removed by distillation under reduced pressure at 10 mmHg, followed by baking at 135° C. for 2 hours.

Next, 100 parts by weight of zinc oxide which is sufficiently crushed with a mortar and treated, 0.5 parts by weight of Exemplary compound (2-1) as the second coupling agent, and 200 parts by weight of toluene are mixed and stirred, followed by reflux for 2 hours. Then, toluene is removed by distillation under reduced pressure at 10 mmHg, followed by baking at 135° C. for 2 hours.

Surface Treatment Example 2

100 parts by weight of zinc oxide (trade name: MZ-300, manufactured by TAYCA CORPORATION) as the metal oxide particles, 0.5 part by weight of N-2-(aminoethyl)-3-aminopropyltrimethoxysilane as the first coupling agent, 0.5 part by weight of Exemplary compound (2-1) as the second coupling agent, and 200 parts by weight of toluene are mixed and stirred, followed by reflux for 2 hours. Then, toluene is removed by distillation under reduced pressure at 10 mmHg, followed by baking at 135° C. for 2 hours.

Surface Treatment Examples 3 to 4

Surface treatments are performed in the same method as that of Surface treatment example 1, except that materials shown in Table 1 are used as the metal oxide particles.

Surface Treatment Example 5

100 parts by weight of zinc oxide (trade name: MZ-300, manufactured by TAYCA CORPORATION) as the metal oxide particles, 0.5 part by weight of N-2-(aminoethyl)-3-aminopropyltrimethoxysilane as the coupling agent, and 200 parts by weight of toluene are mixed and stirred, followed by reflux for 2 hours. Then, toluene is removed by distillation under reduced pressure at 10 mmHg, followed by baking at 135° C. for 2 hours.

Surface Treatment Examples 6 to 12

Surface treatments are performed under the same conditions as those of Surface treatment example 1, except for conditions shown in Table 1.

TABLE 1

| | Metal Oxide Particles | | | First Coupling Agent | | Second Coupling Agent | |
|---|---|---|---|---|---|---|---|
| Surface Treatment Example No. | Kind (Material Name) | Trade name | Amount (Part By Weight) | Kind (Material Name) | Amount (Part By Weight) | Kind (Exemplary Compound No.) | Amount (Part By Weight) |
| 1 | Zinc Oxide | MZ-300, manufactured by TAYCA CORPORATION | 100 | N-2-(aminoethyl)-3-aminopropyltrimethoxysilane | 0.5 | 2-1 | 0.5 |
| 2 | Zinc Oxide | MZ-300, manufactured by TAYCA CORPORATION | 100 | N-2-(aminoethyl)-3-aminopropyltrimethoxysilane | 0.5 | 2-1 | 0.5 |

TABLE 1-continued

| Surface Treatment Example No. | Metal Oxide Particles: Kind (Material Name) | Trade name | Amount (Part By Weight) | First Coupling Agent: Kind (Material Name) | Amount (Part By Weight) | Second Coupling Agent: Kind (Exemplary Compound No.) | Amount (Part By Weight) |
|---|---|---|---|---|---|---|---|
| 3 | Titanium Oxide | TAF 500J, manufactured by FUJI TITANIUM INDUSTRY CO., LTD. | 100 | N-2-(aminoethyl)-3-aminopropyltrimethoxysilane | 0.5 | 2-1 | 0.5 |
| 4 | Tin Oxide | S1, manufactured by Mitsubishi Materials Corporation | 100 | N-2-(aminoethyl)-3-aminopropyltrimethoxysilane | 0.5 | 2-1 | 0.5 |
| 5 | Zinc Oxide | MZ-300, manufactured by TAYCA CORPORATION | 100 | N-2-(aminoethyl)-3-aminopropyltrimethoxysilane | 0.5 | None | 0 |
| 6 | Zinc Oxide | MZ-300, manufactured by TAYCA CORPORATION | 100 | N-2-(aminoethyl)-3-aminopropyltrimethoxysilane | 0.3 | 2-1 | 0.7 |
| 7 | Zinc Oxide | MZ-300, manufactured by TAYCA CORPORATION | 100 | N-2-(aminoethyl)-3-aminopropyltrimethoxysilane | 0.7 | 2-1 | 0.3 |
| 8 | Zinc Oxide | MZ-300, manufactured by TAYCA CORPORATION | 100 | N-2-(aminoethyl)-3-aminopropyltrimethoxysilane | 0.2 | 2-1 | 0.8 |
| 9 | Zinc Oxide | MZ-300, manufactured by TAYCA CORPORATION | 100 | N-2-(aminoethyl)-3-aminopropyltrimethoxysilane | 0.8 | 2-1 | 0.2 |
| 10 | Zinc Oxide | MZ-300, manufactured by TAYCA CORPORATION | 100 | N-2-(aminoethyl)-3-aminopropyltrimethoxysilane | 1.5 | 2-1 | 1 |
| 11 | Zinc Oxide | MZ-300, manufactured by TAYCA CORPORATION | 100 | N-2-(aminoethyl)-3-aminopropyltrimethoxysilane | 2 | 2-1 | 1.5 |
| 12 | Zinc Oxide | MZ-300, manufactured by TAYCA CORPORATION | 100 | N-2-(aminoethyl)-3-aminopropyltrimethoxysilane | 0.05 | 2-1 | 0.05 |

Example 1

33 parts by weight of zinc oxide with the particles of which the surfaces are treated according to Surface treatment example 1, 6 parts by weight of blocked isocyanate (SUMIDUR 3175, manufactured by Sumitomo Bayer Urethane Co., Ltd.), 1 part by weight of electron-accepting compound (Exemplary compound (1-8)), and 25 parts by weight of methyl ethyl ketone are mixed for 30 minutes. Then, 5 parts by weight of butyral resin S-LEC BM-1 (manufactured by SEKISUI CHEMICAL CO., LTD.) is added thereto, followed by dispersion using a sand mill for 3 hours. After the dispersion is finished, 3 parts by weight of silicone balls (TOSPEARL 130, manufactured by GE Toshiba Silicone Co., Ltd.) is added thereto. As a result, a dispersion (undercoat-layer-forming coating solution) is obtained.

Furthermore, an aluminum substrate having a diameter of 30 mm, a length of 404 mm, and a thickness of 1 mm is coated with this coating solution using a dip coating method, and the coating solution is dried and hardened at 180° C. for 30 minutes. As a result, an undercoat layer having a thickness of 20 μm is obtained.

Next, a mixture of 15 parts by weight of hydroxygallium phthalocyanine as the charge generation material, 10 parts by weight of vinyl chloride-vinyl acetate copolymer resin (VMCH, manufactured by Nippon Unicar Co, Ltd), and 300 parts by weight of n-butyl alcohol is dispersed for 4 hours using a sand mill. The obtained dispersion is dip-coated on the undercoat layer, followed by drying at 100° C. for 10 minutes. As a result, a charge generation layer having a thickness of 0.2 μm is formed.

Furthermore, a coating solution, in which 4 parts by weight of N—N'-diphenyl-N,N'-bis(3-methylphenyl)-[1,1']biphenyl-4,4'-diamine, and 6 parts by weight of bisphenol Z polycarbonate resin (viscosity average molecular weight: 40,000) are added to 25 parts by weight of tetrahydrofuran and 5 parts by weight of chlorobenzene and dissolved therein, is coated on the charge generation layer, followed by drying at 130° C. for 40 minutes. As a result, a charge transport layer having a thickness of 30 μm is formed.

The photoreceptor thus obtained is mounted to a copying machine (DocuCentre C4535; manufactured by Fuji Xerox Co., Ltd.; a device having a contact charging roll as the charging device) and 10,000 halftone images (image density: 50%) are continuously printed in an A4 horizontal feed mode.

The image quality of the first-printed image (initial image quality) and the image quality of an image after 10,000 images are printed (image quality after 10,000 images being printed) are respectively evaluated for graininess and ghost.

Graininess Evaluation

Graininess is evaluated through a process in which halftone images having image densities of 30%, 40%, and 50% are printed and visually inspected.

Evaluation criteria are as follows.

A: There is no problem

B: There is a small problem which is practically allowable

C: There is a problem

Ghost Evaluation

Figure 8:
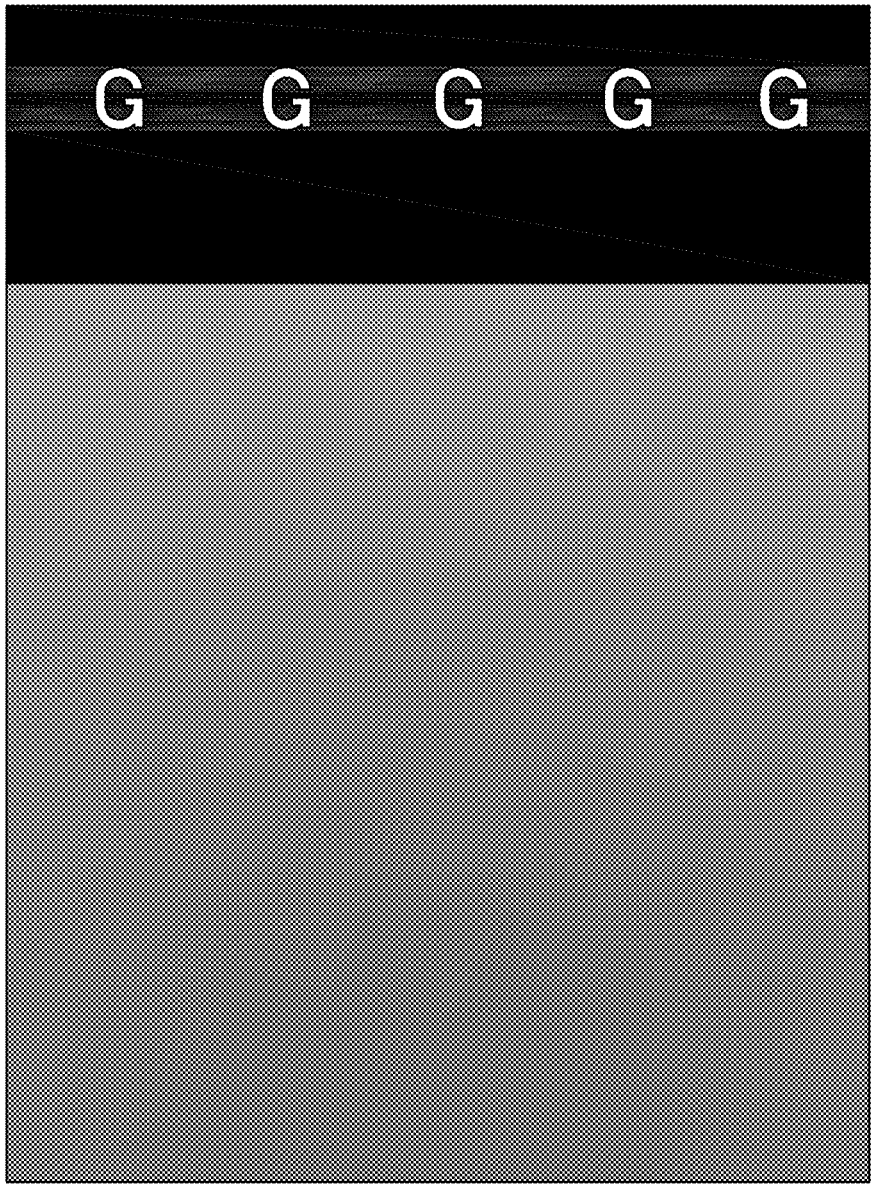
FIG. 8 is a diagram schematically illustrating a chart used for ghost evaluation in Examples.

Ghost is evaluated using a chart shown in FIG. 8. In the chart shown in FIG. 8, a region where white characters "G" are shown in a black solid image having an image density of 100% and a region where a halftone image having an image density of 40% are printed.

Evaluation criteria are as follows.

A: There is no problem

B: There is a small problem which is practically allowable

C: There is a problem

Examples 2 to 4

Photoreceptors are prepared in the same preparation method as that of Example 1, except that metal oxide particles of which the surfaces are respectively treated according to Surface Treatment Examples 2, 3, and 4 are used in the formation of undercoat layers; and evaluated in the same method. The results are shown in Table 2.

Comparative Example 1

A photoreceptor is prepared in the same preparation method as that of Example 1, except that metal oxide particles of which the surfaces are treated according to Surface Treatment Example 5 are used in the formation of an undercoat layer; and evaluated in the same method. The results are shown in Table 2.

Comparative Example 2

A photoreceptor is prepared in the same preparation method as that of Example 1, except that MZ-300 (manufactured by TAYCA CORPORATION, no surface treatment) is used as zinc oxide and the electron-accepting compound is not used in the formation of an undercoat layer; and evaluated in the same method. The results are shown in Table 2.

Example 5

A photoreceptor is prepared in the same preparation method as that of Example 1, except that Exemplary compound (1-9) is used as the electron-accepting compound in the formation of an undercoat layer; and evaluated in the same method. The results are shown in Table 2.

Example 6

A photoreceptor is prepared in the same preparation method as that of Example 1, except that 1.5 parts by weight of Exemplary compound (1-14) is used as the electron-accepting compound in the formation of an undercoat layer; and evaluated in the same method. The results are shown in Table 2.

Example 7

A photoreceptor is prepared in the same preparation method as that of Example 1, except that 1 part by weight of Exemplary compound (1-21) is used as the electron-accepting compound in the formation of an undercoat layer; and evaluated in the same method. The results are shown in Table 2.

Examples 8 to 14

Photoreceptors are prepared under the same conditions as those of Example 1, except for conditions shown in Table 2; and evaluated in the same method. The results are shown in Table 2.

It can be seen from the above results that the evaluation results of the initial image quality for graininess and ghost in the Examples are superior to those of the Comparative Examples.

Furthermore, it can be seen from the above results that, the evaluation results of the image quality after 10,000 images being printed for graininess and ghost in the Examples are superior to those of the Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

an undercoat layer which is provided on the conductive substrate and includes a binder resin and metal oxide particles of which the surfaces are treated with at least two kinds of coupling agents of a first coupling agent having an electron-donating group and a second coupling agent having an electron-accepting group; and a photosensitive layer which is provided on the undercoat layer.

2. The electrophotographic photoreceptor according to claim 1, wherein the first coupling agent is a silane coupling agent having an amino group.

3. The electrophotographic photoreceptor according to claim 1, wherein the second coupling agent is a silane coupling agent having a fluorine-containing group.

TABLE 2

| | Undercoat Layer Composiition | | | Initial Image Quality | | Image Quality After 10,000 Images Being Printed | |
|---|---|---|---|---|---|---|---|
| | Metal Oxide Particles | | Electron-Accepting | Graininess | Ghost | Graininess | Ghost |
| | Material Name | Surface Treatment Example No. | Compound | Evaluation | Evaluation | Evaluation | Evaluation |
| Example 1 | Zinc Oxide | Surface Treatment Example 1 | 1-8 | A | A | A | A |
| Example 2 | Zinc Oxide | Surface Treatment Example 2 | 1-8 | A | A | A | A |
| Example 3 | Titanium Oxide | Surface Treatment Example 3 | 1-8 | B | A | B | A |
| Example 4 | Tin Oxide | Surface Treatment Example 4 | 1-8 | A | A | A | B |
| Example 5 | Zinc Oxide | Surface Treatment Example 1 | 1-9 | A | A | A | A |
| Example 6 | Zinc Oxide | Surface Treatment Example 1 | 1-14 | A | A | B | A |
| Example 7 | Zinc Oxide | Surface Treatment Example 1 | 1-21 | B | A | B | A |
| Example 8 | Zinc Oxide | Surface Treatment Example 6 | 1-8 | A | A | A | A |
| Example 9 | Zinc Oxide | Surface Treatment Example 7 | 1-8 | A | A | A | B |
| Example 10 | Zinc Oxide | Surface Treatment Example 10 | 1-8 | A | A | A | B |
| Example 11 | Zinc Oxide | Surface Treatment Example 12 | 1-8 | B | A | B | A |
| Example 12 | Zinc Oxide | Surface Treatment Example 8 | 1-8 | A | B | A | B |
| Example 13 | Zinc Oxide | Surface Treatment Example 9 | 1-8 | A | A | A | B |
| Example 14 | Zinc Oxide | Surface Treatment Example 11 | 1-8 | A | B | B | A |
| Comparative Example 1 | Zinc Oxide | Surface Treatment Example 5 | 1-8 | C | A | C | B |
| Comparative Example 2 | Zinc Oxide | None | None | C | C | C | C |

4. The electrophotographic photoreceptor according to claim 1, wherein the first coupling agent is a silane coupling agent having an amino group, and the second coupling agent is a silane coupling agent having a fluorine-containing group.

5. The electrophotographic photoreceptor according to claim 2, wherein the silane coupling agent having an amino group is at least one kind of silane coupling agent selected from a group consisting of N-2-(aminoethyl)-3-aminopropyl methyl dimethoxysilane, N-2-(aminoethyl)-3-aminopropyltrimethoxysilane, N-2-(aminoethyl)-3-aminopropyltriethoxysilane, 3-aminopropyltrimethoxysilane, 3-aminopropyltriethoxysilane, 3-triethoxysilyl-N-(1,3-dimethyl-butylidene)propylamine, and N-phenyl-3-aminopropyltrimethoxysilane.

6. The electrophotographic photoreceptor according to claim 3, wherein the silane coupling agent having a fluorine-containing group is represented by Formula (F):

$$F_3C—(CF_2)_{n1}—(CH_2)_{n2}—Si(OR_f)_3 \quad (F)$$

wherein in Formula (F), $R_f$ represents an alkyl group having from 1 to 5 carbon atoms, n1 represents an integer of from 0 to 8, and n2 represents an integer of from 0 to 5.

7. The electrophotographic photoreceptor according to claim 3, wherein the silane coupling agent having a fluorine-containing group is represented by Formula (F):

$$F_3C—(CF_2)_{n1}—(CH_2)_{n2}—Si(OR_f)_3 \quad (F)$$

wherein in Formula (F), $R_f$ represents an alkyl group having from 1 to 3 carbon atoms, n1 represents an integer of from 0 to 5, and n2 represents an integer of from 0 to 3.

8. The electrophotographic photoreceptor according to claim 3, wherein the silane coupling agent having a fluorine-containing group is at least one kind of silane coupling agent selected from a group consisting of silane coupling agents represented by Formulae (2-1) to (2-5):

$$F_3C—(CH_2)_2—Si(OMe)_3 \quad (2\text{-}1):$$

$$F_3C—(CF_2)_3—(CH_2)_2—Si(OMe)_3 \quad (2\text{-}2):$$

$$F_3C—(CF_2)_5—(CH_2)_2—Si(OMe)_3 \quad (2\text{-}3):$$

$$F_3C—(CH_2)_2—Si(OiPr)_3 \quad (2\text{-}4):$$

$$F_3C—(CF_2)_3—(CH_2)_2—Si(OiPr)_3 \quad (2\text{-}5):$$

wherein in Formulae (2-1) to (2-5), Me represents a methyl group and iPr represents an isopropyl group.

9. The electrophotographic photoreceptor according to claim 1, wherein the total surface treatment amount of the coupling agents is from 0.1% by weight to 3% by weight, with respect to the metal oxide particles.

10. The electrophotographic photoreceptor according to claim 1, wherein the ratio of the first coupling agent and the second coupling agent (first coupling agent/second coupling agent) is from 3/7 to 7/3 in terms of weight.

11. The electrophotographic photoreceptor according to claim 1, wherein the ratio of the first coupling agent and the second coupling agent (first coupling agent/second coupling agent) is from 4/6 to 6/4 in terms of weight.

12. The electrophotographic photoreceptor according to claim 1, wherein the metal oxide particles are at least one kind of particles selected from a group consisting of tin oxide particles, titanium oxide particles, and zinc oxide particles.

13. The electrophotographic photoreceptor according to claim 1, wherein the undercoat layer further includes an electron-accepting compound having an acidic group.

14. The electrophotographic photoreceptor according to claim 13, wherein the electron-accepting compound is an anthraquinone derivative.

15. The electrophotographic photoreceptor according to claim 14, wherein the anthraquinone derivative is a compound represented by Formula (1):

Formula (1)

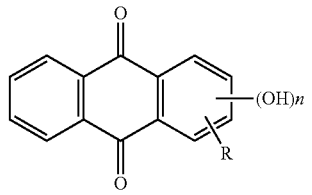

wherein in Formula (1), n represents an integer of from 1 to 3, and R represents a hydrogen atom, an alkyl group having from 1 to 10 carbon atoms, or an alkoxy group having from 1 to 10 carbon atoms.

16. A process cartridge which is detachable from an image forming apparatus, comprising the electrophotographic photoreceptor according to claim 1.

17. The process cartridge according to claim 16, further comprising a contact charging type charging unit.

18. An image forming apparatus comprising:

the electrophotographic photoreceptor according to claim 1;

a charging unit that charges a surface of the electrophotographic photoreceptor;

an electrostatic latent image forming unit that forms an electrostatic latent image on a charged surface of the electrophotographic photoreceptor;

a developing unit that forms a toner image by developing the electrostatic latent image, which is formed on the surface of the electrophotographic photoreceptor, using toner; and a transfer unit that transfers the toner image, which is formed on the surface of the electrophotographic photoreceptor, onto a recording medium.

19. The image forming apparatus according to claim 18, wherein the charging unit is a contact charging type charging unit.

* * * * *